US005367939A

United States Patent [19]

Barker

[11] Patent Number: 5,367,939

[45] Date of Patent: Nov. 29, 1994

[54] HAND HELD CYMBAL DEVICE

[75] Inventor: Daniel F. Barker, Woodstock, Canada

[73] Assignee: Sabian Ltd., Meductic, Canada

[21] Appl. No.: 2,439

[22] Filed: Jan. 13, 1993

[51] Int. Cl.[5] ..... G10D 13/08

[52] U.S. Cl. ..... 84/402; 84/404; 84/422.3; D17/22; 446/421

[58] Field of Search ..... 84/402, 403, 422.3, 84/404; 446/418, 420, 422, 421; D17/22

[56] References Cited

U.S. PATENT DOCUMENTS

| | | | |
|---|---|---|---|
| D. 206,134 | 11/1966 | Gussak | D17/22 |
| 238,465 | 3/1881 | White | 84/402 |
| 1,643,553 | 9/1927 | Gladstone | 84/402 |
| 1,647,795 | 11/1927 | Gladstone | 84/402 |
| 2,417,972 | 3/1947 | D'arcy | 84/422 |
| 3,147,661 | 9/1964 | Padera | 84/422 |
| 3,704,340 | 11/1972 | Hall | 84/402 |
| 4,253,657 | 3/1981 | Rozzelle | 446/418 |
| 5,063,819 | 11/1991 | Hoshino | 84/422.3 |

OTHER PUBLICATIONS

"New Ludwig Handsock Cymbal", The Ludwig Drummer, Twelve.

Avedis Zildjian Special Cymbals, Avedis Zildjian brochure.

*Primary Examiner*—Michael L. Gellner
*Assistant Examiner*—Cassandra C. Spyrou
*Attorney, Agent, or Firm*—Testa, Hurwitz & Thibeault

[57] ABSTRACT

A cymbal device for use with one hand includes a shaft extending along an axis and two cymbals coaxially mounted on the shaft so that one of the cymbals is moveable relative to the other. A trigger mechanism is coupled to the shaft for displacing the moveable cymbal relative to the other cymbal to bring the cymbals into engagement with one another. A handle is secured to the shaft at a position enabling a user to grasp the handle and actuate the trigger mechanism with one hand.

10 Claims, 4 Drawing Sheets

HAND HELD CYMBAL DEVICE

BACKGROUND OF THE INVENTION

The invention relates in general to the field of percussion instruments. In particular, the invention concerns hand held cymbal devices which enable a user to play the cymbals using only one hand.

Typically, cymbals are played in one of several, generally known, configurations. In one configuration, a single cymbal is mounted on a floor stand and rhythmically struck with a drum stick, brush, or other similar instrument. Another configuration, such as is commonly associated with marching bands, is for a player to hold two cymbals, one in each hand, and "crash" the cymbals together by rapidly bringing them into engagement with one another to cause a thunderous sound. Still another known cymbal configuration is typically referred to as a "hi-hat" cymbal and involves two cymbals mounted on a floor stand. The two cymbals are brought into engagement with one another by a foot pedal.

Hi-hat cymbals enable a player to utilize cymbals both via crashing, by simply repeatedly actuating the foot pedal, or by a combination of techniques, such as by repeatedly actuating the foot pedal while also striking the top cymbal with a stick or brush. In either case, a significant advantage of this type of cymbal device is that it leaves one or both of the player's hands available for performing other functions.

To date, no satisfactory device has been proposed which would provide a marching band cymbal player the flexibility afforded by hi-hat cymbals. To the contrary, marching band cymbalists must use both hands to crash their cymbals and are therefore unable to perform any tasks other than cymbal crashing.

It is an object of the invention, therefore, to provide a new and improved construction for the purpose of playing cymbals. Another object of the invention is to provide a cymbal device which enables the playing of cymbals with only one hand. It is still another object of the invention to provide a cymbal device having far broader applications than known cymbal devices have.

SUMMARY OF THE INVENTION

These and other objects are achieved by the present invention which features a cymbal device which enables the cymbals to be played with only one hand. The device includes a shaft which extends along an axis. A pair of cymbals are coaxially mounted on the shaft so that one of the cymbals is moveable relative to the other. A trigger mechanism is coupled to the shaft for displacing the moveable cymbal relative to the other. By actuating the trigger mechanism, therefore, the cymbals are brought into engagement with one another. A handle is coupled to the shaft at a position so that a user can grasp the handle and actuate the trigger mechanism with one hand.

In some embodiments, the trigger mechanism is pivotably fixed to the shaft. In these embodiments, the moveable cymbal slides along the shaft upon actuation of the trigger which may or may not be secured to the cymbal. Upon release of the trigger, a spring force or gravity causes the cymbals to disengage.

In some embodiments, the trigger mechanism acts to displace the shaft with respect to a slidably mounted cymbal while that cymbal remains substantially stationary. In these embodiments of the invention, the handle and trigger mechanism are not mounted directly on the shaft. Typically, in these embodiments of the invention the shaft passes through a cylindrical member and is capable of reciprocal movement with respect to the cylindrical member. The cylindrical member supports the slidably mounted cymbal and may even act simultaneously as the device's handle.

These and other features and objects of the invention will be more fully appreciated by reference to the following detailed description, which is to be read in conjunction with the attached drawing.

DETAILED DESCRIPTION

As stated, the invention features a cymbal device which can be played using only one hand. In its various embodiments the invention includes trigger-actuated cymbals coaxially mounted on a shaft.

Figure 1:
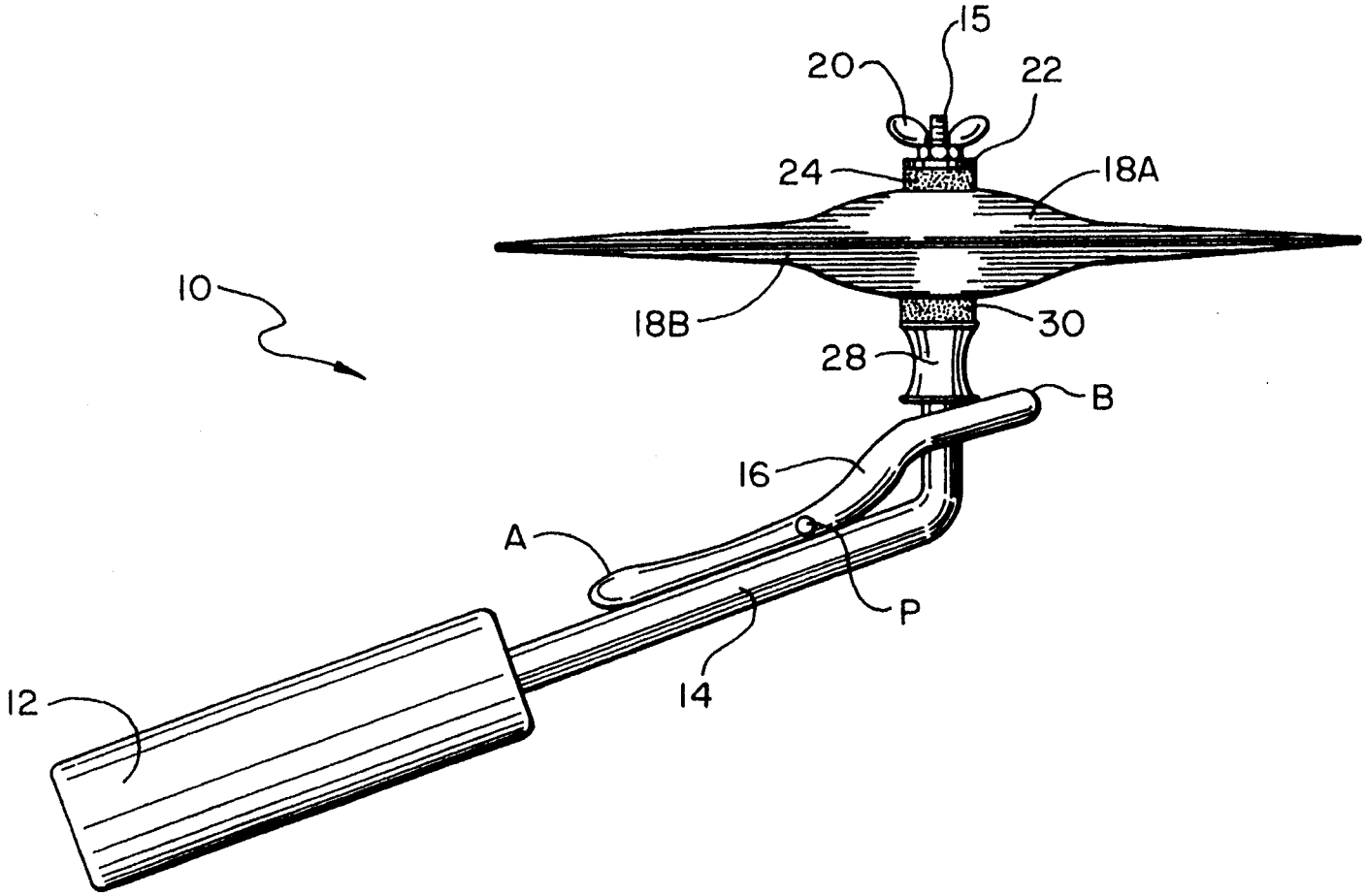
FIG. 1 is a plan view of a one hand cymbal device constructed in accordance with the invention, the cymbals being shown in a engaged state.

One embodiment of the invention is shown in FIG. 1 which depicts a device 10 including a handle 12 mounted on a shaft 14. A trigger mechanism 16 is pivotably mounted to the shaft 14 at point P near the handle 12 so that a user of the device 10 can grasp the handle 12 and actuate the trigger 16 with one hand. The handle 12 may be a discrete element mounted to the shaft 14 but it may also comprise part of the shaft itself. The pivotable connection of the trigger 16 to the shaft 14 can be made in any number of known ways and is accordingly not discussed here in great detail.

While the shaft 14 is shown to be bent, it should be understood that the shaft 14 could also be straight without departing from the spirit and scope of the invention. Such a reconfiguration of the shaft 14 would likely necessitate a trigger mechanism formed differently from the trigger 14, but that would not substantially affect the fundamental manner, as set forth below, in which the device 10 functions.

Figure 2:
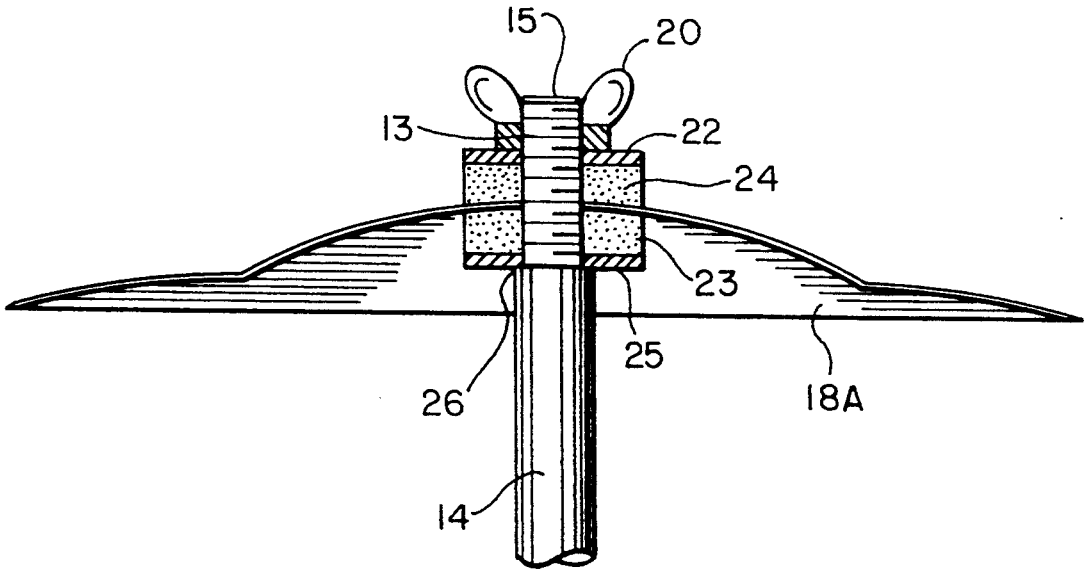
FIG. 2 is a partial, cross-sectional view of the device shown in FIG. 1.

A pair of cymbals 18A and 18B are coaxially mounted on the shaft 14, an end 15 of which is shown extending beyond the cymbal 18A. The cymbal 18A is secured to the shaft 16 by a wing nut 20. As more clearly illustrated in FIG. 2, the wing nut 20 screws onto a threaded potion 13 of the shaft to lock the cymbal 18A against a shoulder 26 on the shaft 14 where the threaded portion 13 ends. A metal washer 22 and a felt washer 24 are arranged between the wing nut 15 and the cymbal 18A. Another set of metal and felt washers 25 and 23 respectively, is positioned underneath the cymbal 18A. Indeed, it is the metal washer 25 which actually lodges against the shoulder 26. This construction allows the cymbal 18A to be secured to the shaft 14 without unduly restricting the ability of the cymbal 18A to vibrate properly.

A spacer 28 (FIG. 1) is slidable on the shaft 14 between an end B of the trigger 16 and the lower cymbal 18B. Another felt washer 30 is positioned between the spacer 28 and the cymbal 18B. The cymbal 18B is not secured at any fixed point along the shaft 14 but, rather, is slidable along the shaft 14.

As illustrated, an end A of the trigger 16 is pressed against the shaft 14 so that, as forced by the end B of the trigger 16, the cymbal 18B is engaged against the cymbal 18A. Upon release of the end A of the trigger 16, the weight of the cymbal 18B acts against the end B of the trigger 16 causing the trigger to pivot about point P. As a result, the cymbal 18B slides down the shaft 14 and separates from the cymbal 18A. Accordingly, repeatedly pressing and releasing the end A of the trigger 16 results in the repeated engagement and disengagement of the cymbals 18A and 18B using only one hand.

In some embodiments of the invention, the cymbals 18A and 18B are urged apart from one another by a spring, coaxially arranged with the shaft 14, between the cymbals. In these embodiments, the inventive device can be played in any orientation, as opposed to the device 10, which must be held upright for the force of gravity to disengage the cymbals 18A and 18B upon release of the trigger 16.

Figure 3:
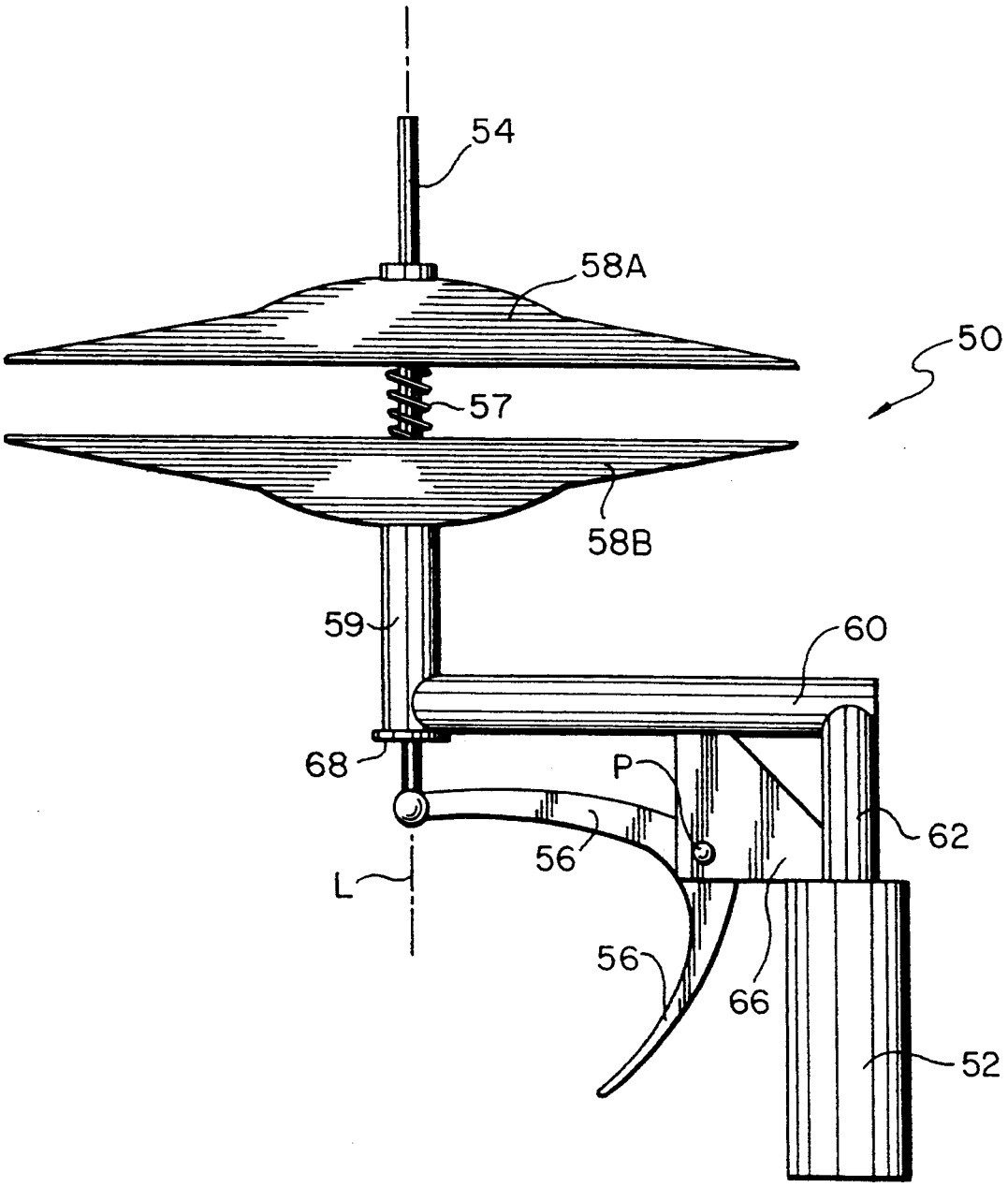
FIG. 3 is a plan view of another one hand cymbal device constructed in accordance with the invention, the cymbals being shown in a disengaged state.

Another embodiment of the invention is shown in FIG. 3 which depicts a device 50 including two cymbals 58A and 58B. The cymbals are coaxially mounted on a shaft 54, with the cymbal 58A being secured at a fixed point along the shaft 54, and the cymbal 58B being slidable along the shaft 54. The cymbal 58A may be secured to the shaft 54 in a variety of ways, such as similarly to the configuration depicted in FIG. 2 with respect to the cymbal 18A. A spring 57 is arranged between the cymbals 58A and 58B for biasing the cymbals apart.

The cymbal 58B is positioned against a cylindrical member 59 and may or may not be attached rigidly thereto. The shaft 54 passes through the cylindrical member 59 and is capable of reciprocal movement along an axis L. It should be understood that the spring 57 could also be arranged within the cylindrical member 59 to urge the shaft 54 upwardly. In such an arrangement, the shaft 54 would likely include a flange or similar surface for receiving a force generated by the spring.

An arm 60 connects a stock 62 to the cylindrical member 59. A handle 52 is mounted on the stock at a position so that a user grasping the handle 52 can use her grasping hand to actuate a C-shaped trigger 56. Again, the handle 52 may or may not be a discrete element from the stock 52. The trigger 56 is supported by a flange 66 and rotates about axis P. The trigger 56 is connected to the shaft 54 by a slot and pin arrangement such as is commonly known, so that rotation of the trigger 56 about the axis P is translated to linear displacement of the shaft 54. Other linkages for attaining this purpose will be apparent.

The device 50 is shown with the cymbals 58A and 58B disengaged under the force of the spring 57. A stop flange 68 or other similar structure prevents excessive displacement of the shaft 54 and thereby provides a maximum distance which the cymbals 58A and 58B can be pushed apart. To engage the cymbals, a user simply pulls the trigger 56 against the handle 52 using a finger of her same hand with which she is grasping the handle 52. Such movement acts against the force of the spring 57 to displace the shaft 54 downwardly, thereby bringing the cymbal 58A into engagement with the cymbal 58B. When the trigger 56 is released, the spring 57 displaces the shaft 54 upwardly, thereby disengaging the cymbals 58A and 58B. The device 50 can be played, therefore, by repeatedly squeezing the trigger 56 against the handle 52 to repeatedly engage the cymbals 58A and 58B.

Figure 4:
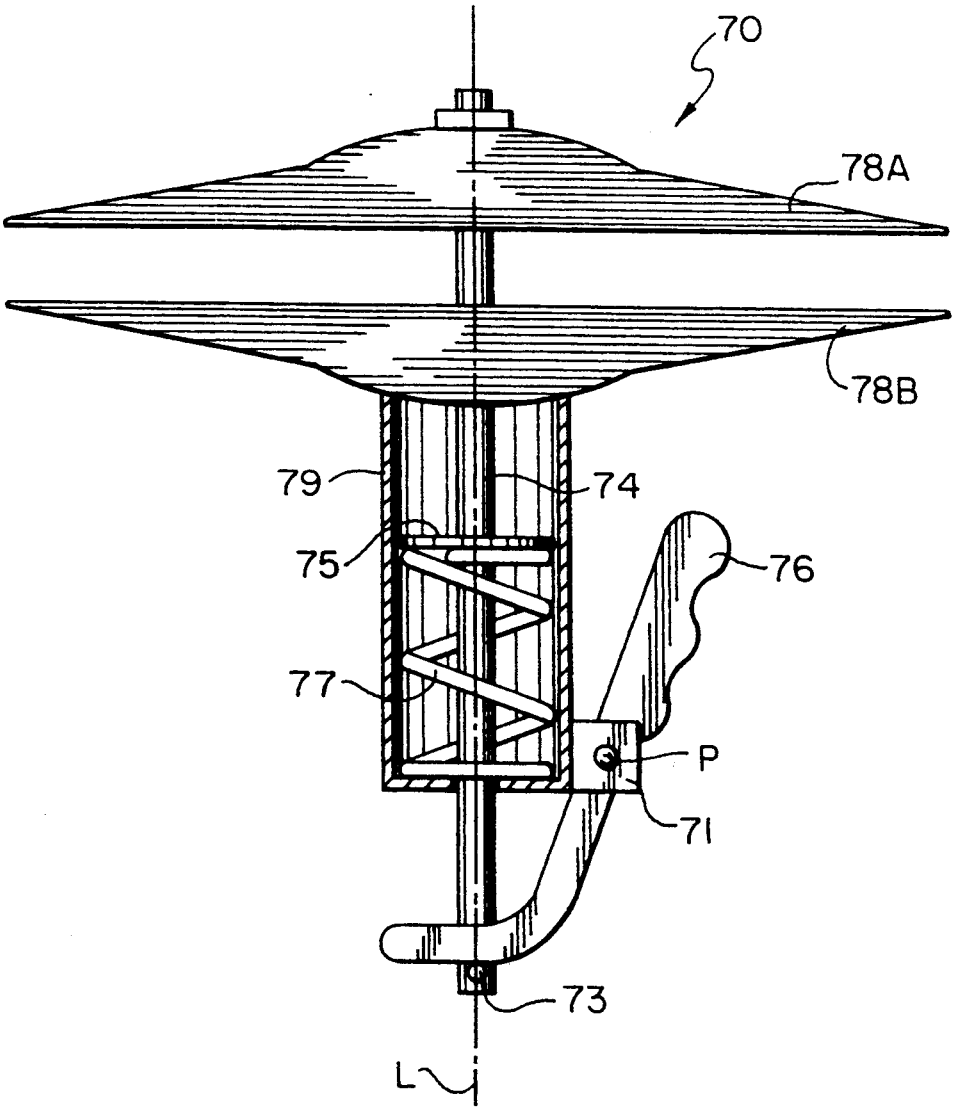
FIG. 4 is a plan view of still another one hand cymbal device constructed in accordance with the invention.

Still another embodiment of the invention is shown in FIG. 4 which depicts a cymbal device 70 including opposed, coaxially aligned cymbals 78A and 78B mounted on a shaft 74. The cymbal 78A is secured to the shaft 74 while the cymbal 78B is slidable along the shaft. The shaft 74 passes through a cylindrical member 79 and is reciprocally moveable within the cylindrical member 79 along an axis L. As discussed, below, the cylindrical member also operates as a handle for the device 70. The shaft 74 passes through a spring 77 which acts against a flange 75 on the shaft 74 to bias the shaft 74 upwardly. A trigger mechanism 76 pivots about an axis P supported by a flange 71 on the cylindrical member 79. A lower end of the trigger mechanism 76 is arranged against a pin 73 on the shaft 74.

As illustrated, the cymbals 78A and 78B are separated from one another under the force of the spring 77. A user grasping the cylindrical member 79, however, can with her same hand pull the trigger mechanism 76 toward the cylindrical member 79 thereby exerting a downwardly oriented force on the pin 73 with the lower end of the trigger mechanism 76. This force opposes the action of the spring 75 and brings the cymbal 78A into engagement with the cymbal 78B. When the trigger 76 is released, the spring 77, acting on the flange 75, urges the shaft 74 upwardly to disengage the cymbals 78A and 78B. Repeatedly squeezing and releasing the trigger 76, therefore, repeatedly engages and disengages the cymbals 78A and 78B.

While specific embodiments of the invention have been set forth in particular detail, it will be apparent to those ordinarily skilled in the art, that various alterations to the described embodiments can be made without departing from the spirit and scope of the invention. The invention is to be defined, therefore, not by the preceding detailed description, but by the claims that follow.

What is claimed is:

1. A cymbal device for holding and playing with one hand, comprising:

a shaft extending along an axis, a first cymbal secured to the shaft, a second cymbal mounted slidably on the shaft and coaxially with the first cymbal, a handle coupled to the shaft for grasping and carrying the cymbal device by a single hand of a user of the cymbal device, and a trigger mechanism pivotably mounted to the shaft at a pivot point, the trigger mechanism including:

a first end extending from the pivot point in a direction away from the handle, the first end coupled to the second cymbal such that movement of the first end causes sliding movement of the second cymbal along the shaft in a direction substantially parallel to the axis; and a second end extending from the pivot point to an area near the handle, the second end for manipulation by the single hand of the user, whereby the second cymbal slides along the shaft and contacts the first cymbal upon manipulation of the second end of the trigger mechanism by the single hand of the user.

2. The cymbal device of claim 1 further comprising a spacer mounted slidably on the shaft between the second cymbal and the first end of the trigger mechanism such that movement of the first end of the trigger mechanism causes sliding movement of the spacer and the second cymbal along the shaft in a direction substantially parallel to the axis.

3. The cymbal device of claim 1 further comprising biasing means disposed around the shaft and between the first and second cymbals such that the first and second cymbals are biased apart from one another.

4. The cymbal device of claim 1 wherein the handle comprises a cylindrical member through which the shaft passes.

5. A cymbal device for holding and playing with one hand, comprising:

a shaft extending along an axis, a first cymbal secured to the shaft, a second cymbal disposed below the first cymbal and mounted slidably on the shaft coaxially with the first cymbal, a spacer member disposed around a portion of the shaft below the second cymbal, the spacer member including a first end near the second cymbal and a second end away from the second cymbal, a handle connected to the second end of the spacer member for grasping and carrying the cymbal device by a single hand of a user of the cymbal device, and a trigger mechanism pivotably mounted to the handle at a pivot point, the trigger mechanism including a first end extending from the pivot point in a direction away from the handle, the first end of the trigger mechanism coupled to the shaft at a point below the second end of the spacer member such that movement of the first end of the trigger mechanism causes movement of the shaft and the first cymbal relative to the spacer member in a direction substantially parallel to the axis; and a second end extending from the pivot point to an area near the handle, the second end of the trigger mechanism for manipulation by the single hand of the user, whereby the first cymbal moves with the shaft and contacts the second cymbal upon manipulation of the second end of the trigger mechanism by the single hand of the user.

6. The cymbal device of claim 5 further comprising biasing means disposed around the shaft and between the first and second cymbals such that the first and second cymbals are biased apart from one another.

7. A cymbal device for holding and playing with one hand, comprising:

a handgrip member having a passage therethrough extending along an axis, the handgrip member for grasping and carrying the cymbal device by a single hand of a user of the cymbal device, a shaft passing through the passage of the handgrip member, a first cymbal secured to the shaft, a second cymbal slidably mounted on the shaft coaxially with the first cymbal between the first cymbal and the handgrip member, biasing means disposed around the shaft for biasing the first cymbal away from the second cymbal, and a trigger mechanism pivotably mounted to the handgrip member at a pivot point, the trigger mechanism including a first end extending away from the pivot point and coupled to the shaft at a point below the handgrip member such that movement of the first end of the trigger mechanism causes reciprocal movement of the shaft and the first cymbal relative to the handgrip member in opposition to the force of the biasing means and in a direction substantially parallel to the axis; and a second end extending from the pivot point to an area near the handle, the second end of the trigger mechanism for manipulation by the single hand of the user, whereby the first cymbal moves with the shaft and contacts the second cymbal upon manipulation of the second end of the trigger mechanism by the single hand of the user.

8. The cymbal device of claim 7 wherein the handgrip member comprises a cylindrical member.

9. The cymbal device of claim 7 wherein the biasing means is disposed within the passage of the handgrip member.

10. The cymbal device of claim 7 wherein the biasing means is disposed between the first and second cymbals.

* * * * *